US010912441B2

(12) United States Patent
Choi et al.

(10) Patent No.: US 10,912,441 B2
(45) Date of Patent: Feb. 9, 2021

(54) DISHWASHER

(71) Applicant: LG Electronics Inc., Seoul (KR)

(72) Inventors: Yongjin Choi, Seoul (KR); Shinwoo Han, Seoul (KR); Taehee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 80 days.

(21) Appl. No.: 16/323,200

(22) PCT Filed: Aug. 3, 2017

(86) PCT No.: PCT/KR2017/008407
§ 371 (c)(1),
(2) Date: Feb. 4, 2019

(87) PCT Pub. No.: WO2018/026216
PCT Pub. Date: Feb. 8, 2018

(65) Prior Publication Data

US 2019/0200837 A1 Jul. 4, 2019

(30) Foreign Application Priority Data

Aug. 4, 2016 (KR) ..... 10-2016-0099555

(51) Int. Cl.
*A47L 15/10* (2006.01)
*B05B 1/00* (2006.01)
(Continued)

(52) U.S. Cl.
CPC ..... *A47L 15/10* (2013.01); *A47L 15/0007* (2013.01); *A47L 15/42* (2013.01); *A47L 15/4219* (2013.01);
(Continued)

(58) Field of Classification Search
None
See application file for complete search history.

(56) References Cited

U.S. PATENT DOCUMENTS

2014/0069469 A1* 3/2014 Choi ..... A47L 15/4289 134/102.2
2018/0134994 A1* 5/2018 Steele ..... C11D 3/3953

FOREIGN PATENT DOCUMENTS

JP 2006247013 9/2006
JP 2008086868 4/2008
(Continued)

OTHER PUBLICATIONS

Espacenet, JP2008119151, Dishwasher, Matsushita Electric 2008 (Year: 2008).*
(Continued)

*Primary Examiner* — Cristi J Tate-Sims
(74) *Attorney, Agent, or Firm* — Fish & Richardson P.C.

(57) ABSTRACT

A dishwasher includes: a spray module which sprays washing water toward dishes; a sump which supplies washing water to the spray module; a pump which pumps washing water stored in the sump to the spray module; and an air jet generator which receives a part of washing water pumped from the pump to form an air bubble in washing water and discharges the air bubble to the sump, wherein the air jet generator comprises: a decompression portion which decreases a pressure of washing water; an air suction portion which is opened to allow air to flow into the decompression portion; a pressing portion which increases pressure so as to crush the air introduced from the air suction portion; and an air tap which has a plurality of holes configured to crush the air contained in washing water that passed through the pressing portion.

20 Claims, 11 Drawing Sheets

(51) Int. Cl.
*A47L 15/42* (2006.01)
*A47L 15/00* (2006.01)

(52) U.S. Cl.
CPC ..... *A47L 15/4236* (2013.01); *A47L 15/4289* (2013.01); *B05B 1/002* (2018.08); *A47L 2601/02* (2013.01); *A47L 2601/16* (2013.01)

(56) References Cited

FOREIGN PATENT DOCUMENTS

| | | |
|---|---|---|
| JP | 2008119151 | 5/2008 |
| JP | 2014147901 | 8/2014 |
| JP | 5794338 | 10/2015 |

OTHER PUBLICATIONS

Espacenet, JP2008086868, Microbubble Generator, Kawamoto Pump, 2008 (Year: 2008).*
Espacenet, JP2014168778, Gas-Liquid Mixing Device, Mitsubushi Electric, 2015 (Year: 2015).*

* cited by examiner

DISHWASHER

CROSS-REFERENCE TO RELATED APPLICATIONS

This application is a National Stage application under 35 U.S.C. § 371 of International Application No. PCT/KR2017/008407, filed on Aug. 3, 2017. which claims the benefit of Korean Application No. 10-2016-0099555, filed on Aug. 4, 2016. The disclosures of the prior applications are incorporated by reference in their entirety.

TECHNICAL FIELD

The present invention relates to a dishwasher, and more particularly, to a dishwasher including an air jet generator for generating an air bubble therein.

BACKGROUND ART

A dishwasher is a household appliance that removes foreign matter remaining on a cleaning target object by spraying washing water on the cleaning target object. The dishwasher sprays washing water to the cleaning target object accommodated in a rack according to a cleaning course selected by a user to remove the dirt from the cleaning target object.

As a method for effectively removing foreign matter adhered to the dishes, a method of using a detergent having a strong cleaning ability, a method of increasing the spraying pressure of the washing water can be utilized, or a method of containing an air bubble in the washing water may be utilized.

The washing water containing the air bubble generates free radicals having excellent sterilizing power and chemical decomposing ability while the air bubble is dissipated, thereby effectively removing foreign matter adhered to the dishes.

However, in the air bubble, as the size of the bubble becomes smaller, the total interfacial area becomes larger, the surfacing speed becomes slower, and internal pressure becomes larger, thereby having an excellent adsorption of hydrophobic molecule, and increasing the availability of gas.

Therefore, when a large amount of air bubbles having a minute size are contained in the washing water, a large effect can be obtained for washing the dishes.

However, in order to form such an air bubble, a component is required to perform a process of injecting air into the washing water flowing in the dishwasher and crushing the injected air, and a separate device is required to inject such air or to crush the air.

Further, there is a problem that a separate pump is required to supply the washing water into an apparatus for forming the air bubble.

DISCLOSURE

Technical Problem

The present invention has been made in view of the above problems, and provides a dishwasher having improved cleaning ability by washing dishes with washing water containing air bubbles.

It is an object of the present invention to provide a dishwasher which forms an air bubble in washing water by sucking outside air without a separate device for injecting air.

It is an object of the present invention to provide a dishwasher which forms an air bubble in washing water by using a conventional pump for dishwashing without a separate pump for supplying washing water to an air jet generator for forming air bubbles.

It is an object of the present invention to provide a dishwasher which forms an air bubble of a minute size by crushing an air bubble formed in washing water to the utmost. The problems of the present invention are not limited to the above-mentioned problems, and other problems not mentioned can be clearly understood by those skilled in the art from the following description.

Technical Solution

In an aspect, there is provided a dishwasher, including: a spray module which sprays washing water toward dishes; a sump which supplies washing water to the spray module; a pump which pumps the washing water stored in the sump to the spray module; and an air jet generator which receives a part of the washing water pumped from the pump to form an air bubble in the washing water and discharges the air bubble to the sump, wherein the air jet generator includes: a decompression portion which decreases a pressure of the washing water that flows; an air suction portion which is opened to allow air to flow into the decompression portion; a pressing portion which increases pressure so as to crush the air introduced from the air suction portion; and an air tap which has a plurality of holes formed therein so as to crush the air contained in washing water that passed through the pressing portion.

The dishwasher further includes an impeller for applying centrifugal force to the washing water that flows to the decompression portion. The impeller includes an impeller circumferential portion having an annular outer shape and a vane disposed inside the impeller circumferential portion to apply centrifugal force to washing water.

The air suction portion is disposed in a portion where decompression of the decompression portion is terminated and negative pressure is formed in the air suction portion, so that the outside air is sucked in by itself.

The air suction portion forms an air suction port opened upwardly, so that that water in the air jet generator does not permeate into or is not accumulated in the air suction portion.

A width of a discharge end of the pressing portion is larger than a width of an inflow end of the decompression portion, so that the sucked air can be crushed well.

A shape of the plurality of holes formed in the air tap is elongated in a left and right direction, so that the sucked air can be crushed well.

The air tap has a thickness ranging from 2 to 5 mm, thereby minimizing the clogging of the air tap due to foreign matter.

A distance between the air tap and the pressing portion is equal to or larger than a diameter of a cross-section of the air tap, so that the sucked air can be crushed well.

The dishwasher further includes a branch pipe for sending a part of the washing water pumped from the pump to the air jet generator so that it is possible to utilize a pump for spraying washing water to the dishes without a separate pump for the washing water supplied to the air jet generator.

The air jet generator is disposed below the tub, thereby minimizing the noise generated by the air jet generator and utilizing a space.

In the air jet generator, a center of a discharge end of the pressing portion is disposed higher than a center of an inflow end of the decompression portion, so that even if the operation of the air jet generator is stopped, it is possible to prevent the residual water from accumulating in the air jet generator.

In another aspect, there is provided a dishwasher, including: a spray module which sprays washing water toward dishes; a sump which supplies washing water to the spray module; a pump which pumps the washing water stored in the sump to the spray module; and an air jet generator which receives a part of the washing water stored in the sump and forms an air bubble in the washing water; and a high pressure pump that pumps the washing water of the sump to the air jet generator, wherein the air jet generator comprises: an impeller which applies centrifugal force to the washing water that flows; a decompression portion which decreases a pressure of the washing water that passed through the impeller; an air suction portion which is opened to allow air to flow into the decompression portion; a pressing portion which increases pressure so as to crush the air introduced from the air suction portion; and an air tap which has a plurality of holes formed therein so as to crush the air contained in washing water that passed through the pressing portion.

The details of other embodiments are included in the detailed description and drawings.

Advantageous Effects

According to an air jet generator of a dishwasher of the present invention, there are one or more of the following effects.

First, in the dishwasher of the present invention, an air suction portion is formed at a portion where the decompression of the washing water is terminated, so that air bubbles are generated in the washing water by sucking air without a separate apparatus and the dishes are cleaned using washing water containing air bubbles, which has an advantage of excellent washing power.

Secondly, since the air jet generator of the dishwasher according to the present embodiment generates air bubbles in the washing water through a branched flow by branching a part of the washing water supplied from the pump, there is an advantage that air bubbles are generated continuously when the pump of the dishwasher is driven for washing dishes.

Third, there is an advantage that air bubbles can be generated even at a low pressure by using a pump disposed inside the conventional dishwasher without using a separate pump.

Fourth, there is an advantage that some of the flow branched from the pump rotates along an impeller vane, air is sucked and crushed along the air crushing pipe, and the amount of air bubbles generated is maximized while passing through the air tap.

The effects of the present invention are not limited to the effects mentioned above, and other effects not mentioned can be clearly understood by those skilled in the art from the description of the claims.

MODE FOR INVENTION

Figure 1:
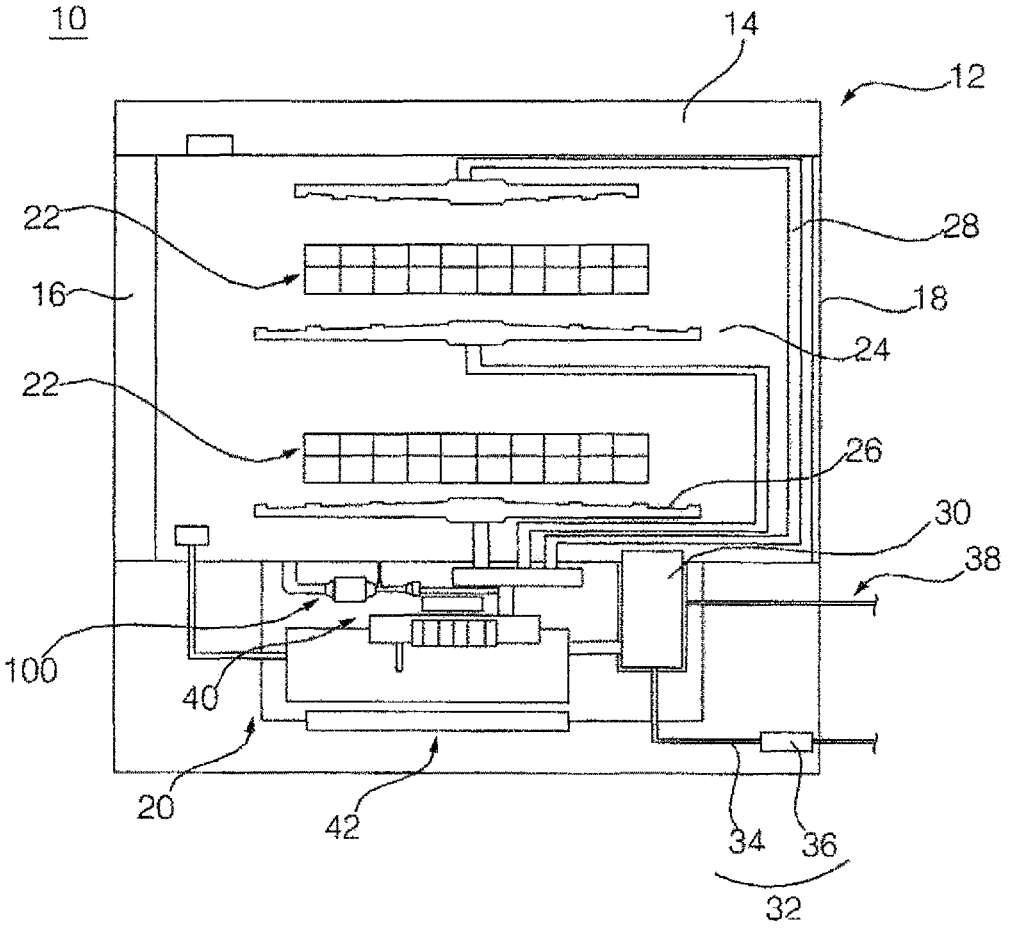
FIG. 1 is a schematic front cross-sectional view of a dishwasher according to an embodiment of the present invention.

Hereinafter, preferred embodiments of the present invention will be described with reference to the accompanying drawings. In describing the present embodiment, the same designations and the same reference numerals are used for the same components, and further description thereof will be omitted.

Hereinafter, an air jet generator of a dishwasher according to embodiments of the present invention will be described with reference to the drawings.

FIG. 1 is a schematic front cross-sectional view of a dishwasher according to an embodiment of the present invention.

Referring to FIG. 1, the dishwasher 10 according to the present embodiment includes a cabinet assembly 12 which forms an outer shape, a rack 22 which is disposed inside the cabinet assembly 12 and on which the dishes are placed, a spray module 24 which is disposed inside the cabinet assembly 12 and sprays washing water toward the dishes, a sump 20 which is disposed inside the cabinet assembly 12 and supplies washing water to the spray module 24, a water supply module 38 which supplies water to the sump 20 or the spray module 24, a drainage module 32 which is connected to the sump 20 and discharges the washing water to the outside, and a filter assembly 30 which is installed in the sump 20 and filters the washing water. In addition, the dishwasher 10 may further include a heater module 42 which is installed in the sump 20 and heats the washing water.

The cabinet assembly 12 forms an outer shape of the dishwasher, and includes a cabinet 14, a door 16 coupled to the cabinet 14 for opening and closing the cabinet 14, and a tub 18 which is installed inside the cabinet 14 and to which washing water or steam is applied, The rack 22 is installed inside the tub 18, and the dishes are placed on the rack 22.

The spray module 24 is implemented to spray washing water toward the dishes. The spray module 24 includes a spray nozzle 26 and a nozzle flow path 28 for supplying washing water to the spray nozzle 26.

A plurality of spray nozzles 26 may be disposed, a plurality of nozzle flow paths 28 corresponding to the spray nozzle 26 are disposed, and a nozzle flow path switching portion for selectively supplying washing water to the nozzle flow path 28 are disposed.

In the present embodiment, the spray module 24 is configured to receive the washing water from the sump 20 storing the washing water and spray the washing water. However, unlike the present embodiment, water may be directly supplied through the water supply module 38.

The water supply module 38 is configured to receive water from the outside and supply the water to the sump 20. In the present embodiment, water is supplied to the sump 20 through the filter assembly 30.

The drainage module 32 is implemented to discharge the washing water stored in the sump 20 to the outside, and includes a drainage flow path 34 and a drainage pump 36.

The filter assembly 30 is implemented to filter foreign matter such as food waste contained in the washing water, and is disposed in a flow path of the washing water flowing from the tub 18 into the sump 20.

To this end, the sump 20 may be provided with a filter mounting portion where the filter assembly 30 is installed, and a filter flow path connecting the filter mounting portion and the inside of the sump 20 may be disposed.

The sump 20 is provided with a sump storing portion for storing the washing water therein, and further includes a pump 40 for pumping the stored washing water to the spray module 24.

The pump 40 pumps the washing water stored in the sump 20 to the spray module 24. The pump 40 is connected to the spray module 24 through a pump flow path.

The pump 40 according to the present embodiment supplies the washing water to the air jet generator 100 in addition to the spray module 24 through a branch pipe 230. The air jet generator 100 is supplied with washing water through a flow path branched from the pump, and sucks gas into the supplied washing water and crushes to generate minute air bubbles. The air jet generator 100 is connected to the tub 18 or the sump 20. Therefore, when the pump is operated, the washing water having air bubbles generated by the air jet generator 100 is supplied into the sump 20, and the washing water pumped to the spray module 24 includes air bubbles.

The sump 20 is connected to a steam flow path and a steam nozzle that spray the steam generated by the heater module 42 into the tub 18. A valve (not shown) for intermitting steam may be installed in the steam flow path. Through the valve, the steam sprayed into the tub 18 may be intermitted and the amount of steam may be adjusted upon occasions.

Here, the steam generated in the sump 20 may be supplied into the tub 18 through the filter flow path and the filter mounting portion, not through the steam nozzle. The sump 20 may be connected to the tub 18 in both directions through the steam flow path and the filter flow path.

Figure 2:
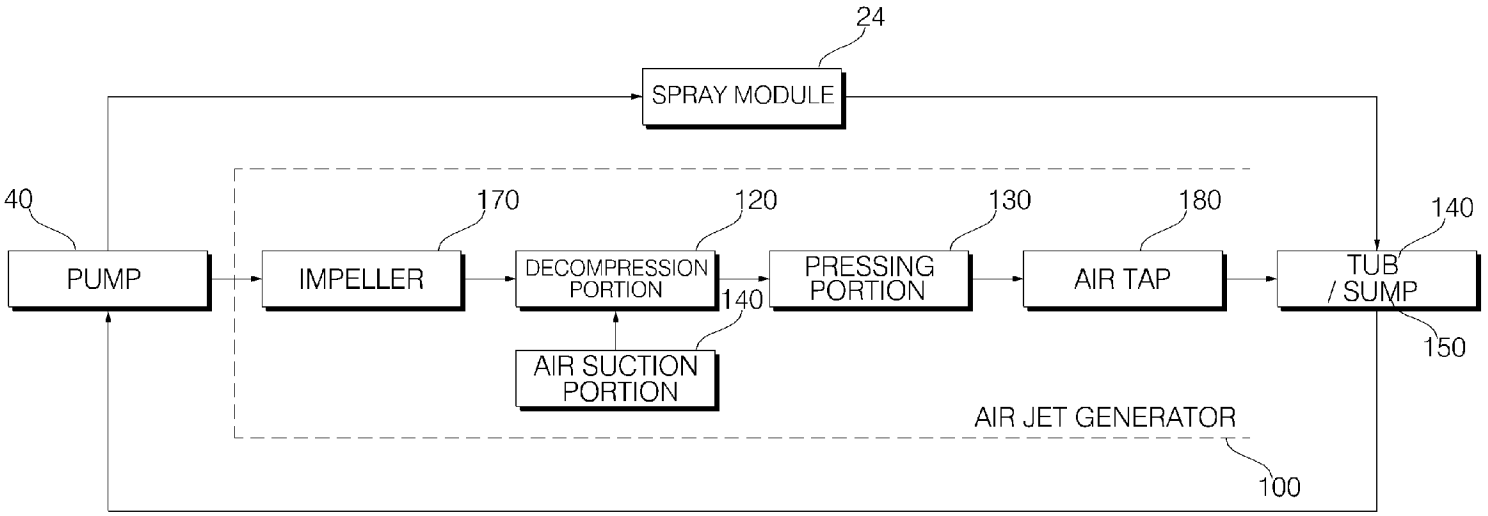
FIG. 2 is a block diagram showing a flow of washing water in a dishwasher including an air jet generator according to an embodiment of the present invention.
Figure 3:
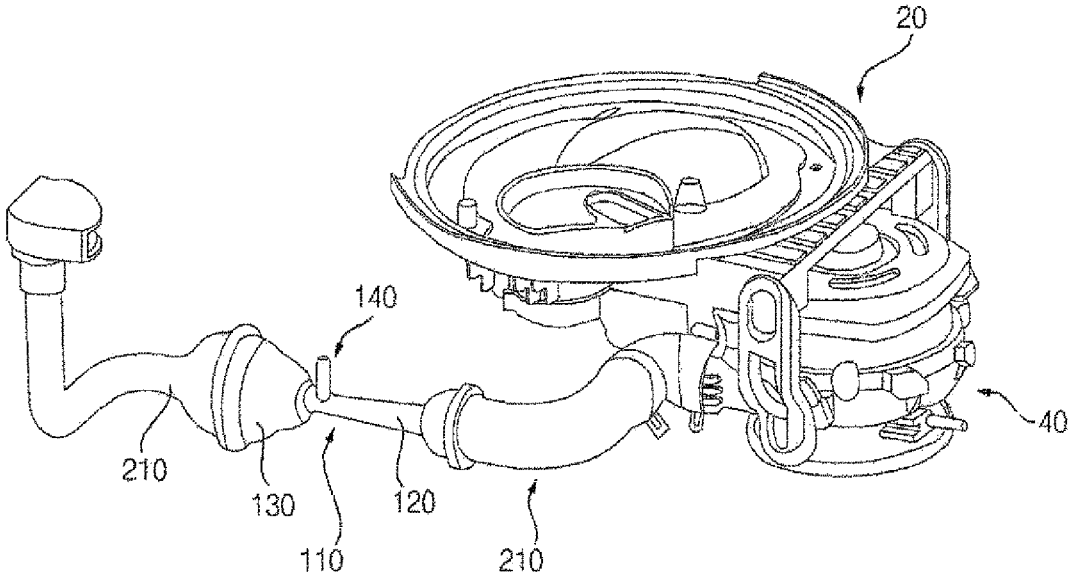
FIG. 3 is a diagram showing an air jet generator and a pump and a sump connected the air jet generator according to the present embodiment.
Figure 4:
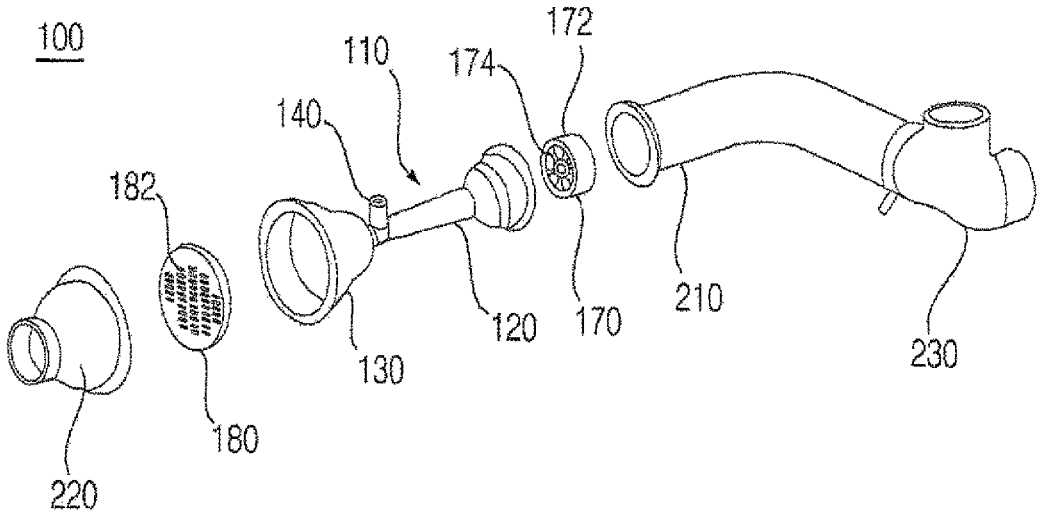
FIG. 4 is an exploded perspective view of the air jet generator according to the present embodiment.
Figure 5:
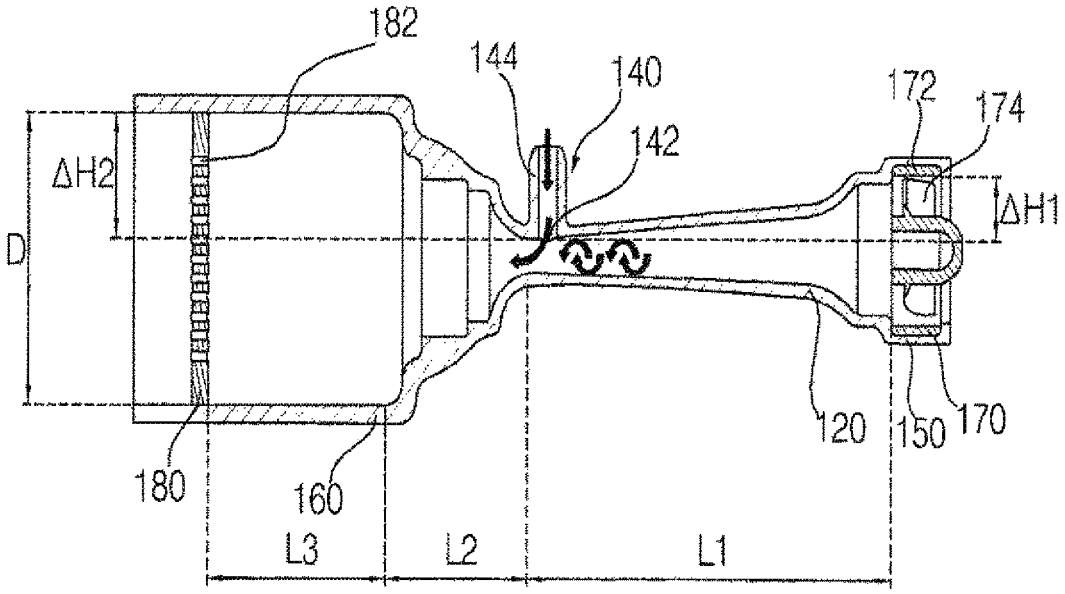
FIG. 5 is a side cross-sectional view for explaining an internal flow path of an air jet generator according to the present embodiment.

FIG. 2 is a block diagram showing a flow of washing water in a dishwasher including an air jet generator according to an embodiment of the present invention. FIG. 3 is a diagram showing an air jet generator and a pump and a sump connected the air jet generator according to the present embodiment. FIG. 4 is an exploded perspective view of the air jet generator according to the present embodiment. FIG. 5 is a side cross-sectional view of an air jet generator according to the present embodiment. FIG. 6 is a front view of an air tap according to an embodiment of the present invention. FIG. 7 is a cross-sectional perspective view of an air tap according to an embodiment of the present invention.

Referring to FIG. 2, the flow of washing water is described. The washing water stored in the sump 20 of the dishwasher 10 is supplied to the spray module 24 through the pump 40, the washing water supplied to the spray module 24 is sprayed into the tub 18, and the washing water sprayed into the tub 18 flows into the sump 20 again. In the dishwasher 10 according to the present embodiment, a part of the washing water that passed through the pump 40 flows into the air jet generator 100 which generates air bubbles in the washing water.

The air jet generator 100 is supplied with a part of the washing water discharged from the pump 40. The air jet generator 100 generates air bubbles in the washing water by passing the introduced washing water through an air crushing pipe 110 including an impeller 170, an air suction portion 140, a decompression portion 120, and a pressing portion 130, and an air tap 180. The washing water containing the air bubbles flows into the sump 20 again. The washing water containing the air bubbles may be discharged to the tub 18 and flow into the sump 20. Therefore, when the pump 40 is operated by the operation of the dishwasher 10, air bubbles are generated in the washing water.

Referring to FIGS. 3 to 7, the air jet generator 100 according to the present embodiment will be described.

The air jet generator 100 according to the present embodiment includes the impeller 170 for applying centrifugal force to the washing water that flows, the decompression portion 120 for reducing the pressure of the washing water that passed through the impeller, the air suction portion 140 for injecting air into the decompression portion, the pressing portion 130 for increasing a pressure to crush the air introduced from the air suction portion, and the air tap 180 having a plurality of holes for crushing the air contained in the washing water passed through the pressing portion.

The decompression portion 120 has a cross-sectional area of the flow path that is decreased in the traveling direction of the washing water. The pressing portion 130 is formed in such a manner that the rate of increase in the cross-section of the flow path per flow path length is larger than the rate of decrease in the cross-section of the flow path per flow path length of the decompression portion. The air suction portion 140 is disposed in a portion where the flow path area of the decompression portion 120 is decreased.

The decompression portion 120 and the pressing portion 130 form a single air crushing pipe 110.

The air jet generator 100 is connected to an inflow pipe 210 for allowing a part of the washing water passed through the pump 40 to flow to the air crushing pipe 110, and is connected to a discharge pipe 220 for discharging the washing water passed through the air crushing pipe 110.

The inflow pipe 210 is connected to the air crushing pipe 110 and sends part of the washing water discharged from the pump 40 to the air crushing pipe 110. The discharge pipe 220 connects the air crushing pipe 110 and the sump 20 or the tub 18 to flow the washing water discharged from the air crushing pipe 110 to the sump 20 or the tub 18.

An inflow end surface 112 of the air crushing pipe 110 and an end surface of the inflow pipe 210 are coupled to each other in a fusing manner at a portion where they are in contact with each other. A discharge end surface 114 of the air crushing pipe 110 and the end surface of the discharge pipe 220 are coupled to each other in a fusing manner at a portion where they are in contact with each other.

Referring to FIG. 5, the impeller 170 is mounted in an impeller mounting portion 150 of the air crushing pipe 110 described below. The impeller 170 is disposed before the decompression portion 120 of the air crushing pipe 110 in the direction in which the washing water flows. Thus, the impeller 170 is not mounted in the impeller mounting portion 150 of the air crushing pipe 110 but may be disposed inside the inflow pipe 210 or between the decompression portion 120 and the inflow pipe 210.

The impeller 170 according to the present embodiment is mounted and fixed to the impeller mounting portion 150. The impeller 170 includes an impeller circumferential portion 172 having an annular outer shape and a vane 174 disposed inside the impeller circumferential portion 172 to apply centrifugal force to the washing water. The impeller circumferential portion 172 abuts against the impeller mounting portion 150 and is fixed.

The washing water passed through the impeller 170 rotates as it passes through the vane 174 to generate a swirling flow. The vane 174 of the impeller 170 applies a centrifugal force to the washing water flowing to the decompression portion 120. The vane 174 of the impeller 170 may be fixed or rotated and applies centrifugal force to the washing water passing through the impeller 170.

The air crushing pipe 110 includes the decompression portion 120 for decompressing the washing water and increasing the speed of the washing water and the pressing portion 130 in which the cross-sectional area of the flow path is drastically increased. The decompression portion 120 is provided with an air suction portion 140 which sucks air from a portion where the washing water is decompressed to form a negative pressure.

The air crushing pipe 110 further includes the impeller mounting portion 150 in which the impeller 170 is mounted and an air tap mounting portion 160 in which the air tap 180 is mounted.

The air crushing pipe 110 is disposed in the order of the impeller mounting portion 150, the decompression portion, the pressing portion, and the air tap mounting portion 160 in the direction in which the washing water flows. The air suction portion 140 is formed at a portion where the flow path cross-sectional area of the decompression portion 120 is reduced. The air suction portion 140 forms a suction port opened upward at a portion where the decompression of the decompression portion 120 is terminated.

The impeller mounting portion 150 is connected to the end of the inflow pipe 210, and the inner circumference of the impeller mounting portion 150 is formed to correspond to the outer circumference of the impeller circumferential portion 172 such that the impeller 170 is mounted and fixed to the impeller mounting portion 150.

The decompression portion 120 is disposed downstream of the impeller mounting portion 150 of the air crushing pipe 110 in the direction in which the washing water flows. The decompression portion 120 is a part of the air crushing pipe 110 through which the washing water that passed through the impeller 170 flows. In the decompression portion 120, the cross sectional area of the flow path is decreased in the progress direction of the washing water such that the pressure of the washing water flowing through the decompression portion 120 is decreased and the speed is increased.

In the decompression portion 120, the cross section of the flow path is gradually decreased in the progress direction of the washing water.

In the air crushing pipe 110, the air suction portion 140 is formed at a portion where the decompression of the decompression portion 120 is terminated. The air suction portion 140 is formed at a portion where the cross-section of the flow path of the decompression portion 120 is reduced. The air suction portion 140 forms an air suction port 142 opened toward the upper side of the dishwasher opposite to the ground to prevent the water from flowing toward the air suction portion and being accumulated even if the pump does not operate.

The air suction portion 140 forms an air suction port 142 opened upward from one side of the decompression portion 120. The air suction portion 140 includes an air suction pipe 144 protruding from one side of the decompression portion 120 to form a flow path through which air is sucked therein. The air suction pipe 144 is connected to a connection pipe (not shown) connected to suck the outside air. The connection pipe is connected to the outside of the dishwasher 10 or into the tub 18. The connection pipe may be coupled to the air suction pipe 144 in a fusing manner.

The air suction pipe 144 may be integrally formed with the connection pipe and directly connected to the outside of the dishwasher 10 or to the tub 18.

In the decompression portion 120, the area of the flow path is decreased toward the progress direction of the washing water so that the pressure of the washing water is lowered, and a negative pressure lower than the atmospheric pressure is formed at a portion where the suction port 42 of the air suction portion 140 is formed such that the outside air is sucked in by itself. The air sucked into the air crushing pipe 110 is primarily crushed by the speed and the swirling force of the washing water flowing inside the decompression portion 120.

The washing water containing the primarily crushed air flows to the pressing portion 130.

The pressing portion 130 is disposed in the next part of the decompression portion 120 of the air crushing pipe 110 in the direction in which the washing water flows. The pressing portion 130 receives the washing water that passed through the decompression portion 120.

The pressing portion 130 increases the pressure to such an extent that the air introduced from the air suction portion 140 is crushed. In the pressing portion 130, the cross-sectional area of the flow path is rapidly increased in the direction in which the washing water flows so that the air contained in the washing water can be crushed. The increasing ratio ($\Delta H2/L2$) of the radius of the flow path cross section per flow path length of the pressing portion 130 is larger than the decreasing ratio ($\Delta H1/L1$) of the radius of the flow path cross section per flow path length of the decompression portion.

The flow path cross-sectional area of a discharge end portion of the pressing portion 130 is formed wider than the flow path cross-sectional area of an inflow end portion of the decompression portion 120. The pressing portion 130 expands larger than the flow path cross-section of the inflow pipe 210 so that the air crushing through a pressure difference occurs effectively.

As the cross-sectional area of the flow path rapidly increases, the speed of the washing water decreases, and the pressure rapidly increases. Due to a sudden increase in pressure, the air in the washing water is secondarily crushed.

In the direction in which the washing water flows, a side end surface of the flow path of the pressing portion 130 increases like a curved line of a quadratic function, and then, is bent in a stepped shape and a side end surface of the flow path is widened. Since the cross section of the flow path of the pressing portion 130 is gradually expanded in a narrow section, air crushing in the washing water through the pressure difference effectively proceeds.

The air tap mounting portion 160 is disposed downstream of the pressing portion 130 of the air crushing pipe 110 in the direction in which the washing water flows. The air tap mounting portion 160 maintains a constant flow path extended from the pressing portion 130, and the air tap 180 is mounted inside the air tap mounting portion 160.

The air tap 180 is mounted in the air tap mounting portion 160 of the air crushing pipe 110. The air tap 180 is fixed to the air tap mounting portion 160. The air tap 180 is disposed at a position spaced apart from the pressing portion 130 by a certain distance.

The air tap 180 has a disk shape, and is provided with a plurality of holes 182 penetrating the inside thereof. The washing water passed through the pressing portion 130 passes through the air tap. The air in the washing water is thirdly crushed while passing through the plurality of holes 182 formed in the air tap 180.

Figure 6A:
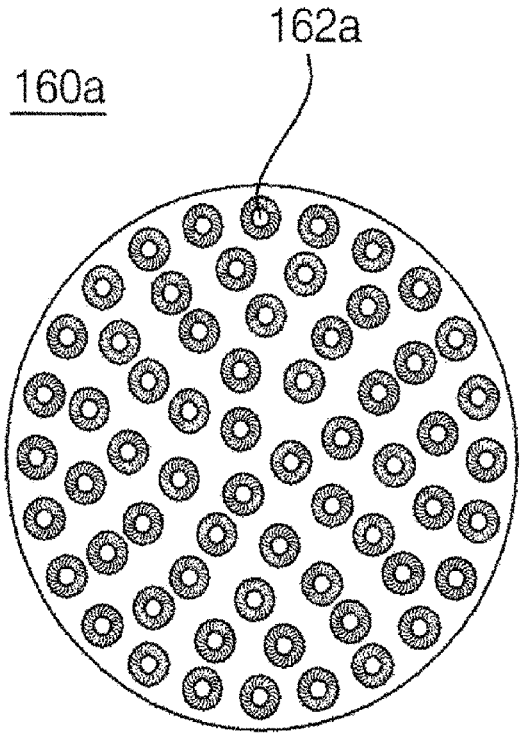
FIG. 6A is a front view of an air tap having a hollowed type hole according to an embodiment of the present invention.
Figure 6B:
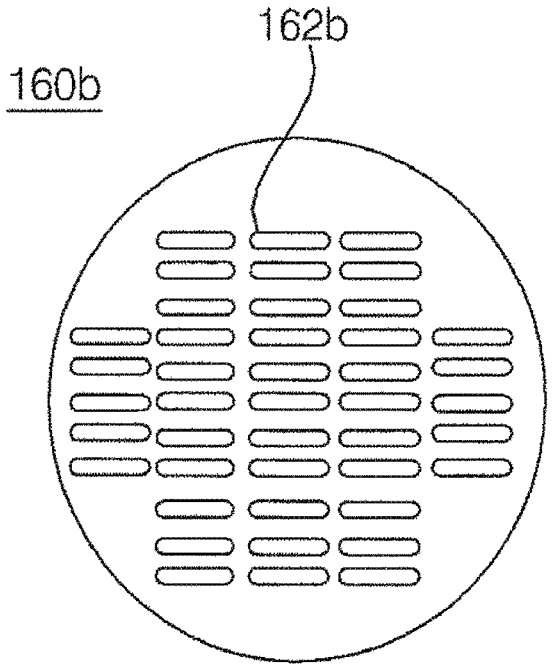
FIG. 6B is a front view of an air tap having a slot type hole according to another embodiment of the present invention.

The holes 182 formed in the air tab 180 are disposed closely to the disk-shaped air tab 180 at regular intervals. The air tap 180 may be an air tap 180*a* having a hollowed type hole 182*a* as shown in FIG. 6A or an air tap 182*b* having a slot type hole 182*b* elongated in the left and right direction as shown in FIG. 6B.

In addition, it may be a cross slot type hole in which an elliptical shape elongated in the vertical direction and an elliptical shape elongated in the left and right direction are combined.

In the hole 182 formed in the air tap 180, as the contact area with the air bubble increases, the shearing force acting on the air bubble increases to increase the amount of generated air bubbles. Thus, the slot type hole is preferable to the hollowed type hole. However, when the size of the hole is excessively increased as in the case of the cross slot type, the air tap may have a reliability problem. Thus, it is preferable that the air tap 180 has a slot type hole.

When the hole of the air tap 180 having the slot type hole is elongated in the left and right direction, and the ratio of the vertical height to the horizontal length of the slot type hole 182*b* is 1:4 to 6, the amount of generated air bubbles increases, and it is also suitable for the reliability of the air tap. Thus, it is preferable that the ratio of the height to the horizontal length of the slot type hole 182*b* is 1:4 to 6.

As the washing water passes through the pressing portion 130, the sucked air is secondarily crushed. The air tap 180 is spaced apart from the pressing portion 130 at a predetermined interval. When the air tab 180 is spaced from the pressing portion 130 at regular intervals, the sucked air is sufficiently secondarily crushed through the pressing portion 130, and then, passes through the air tap 180 again, thereby increasing the amount of generated air bubbles. Therefore, it is preferable that the distance L3 of the air tap 180 spaced from the pressing portion 130 maintains a distance of the diameter size D or more of the cross section of the air tap so as to maximize the amount of generated air bubbles.

Figure 7A:
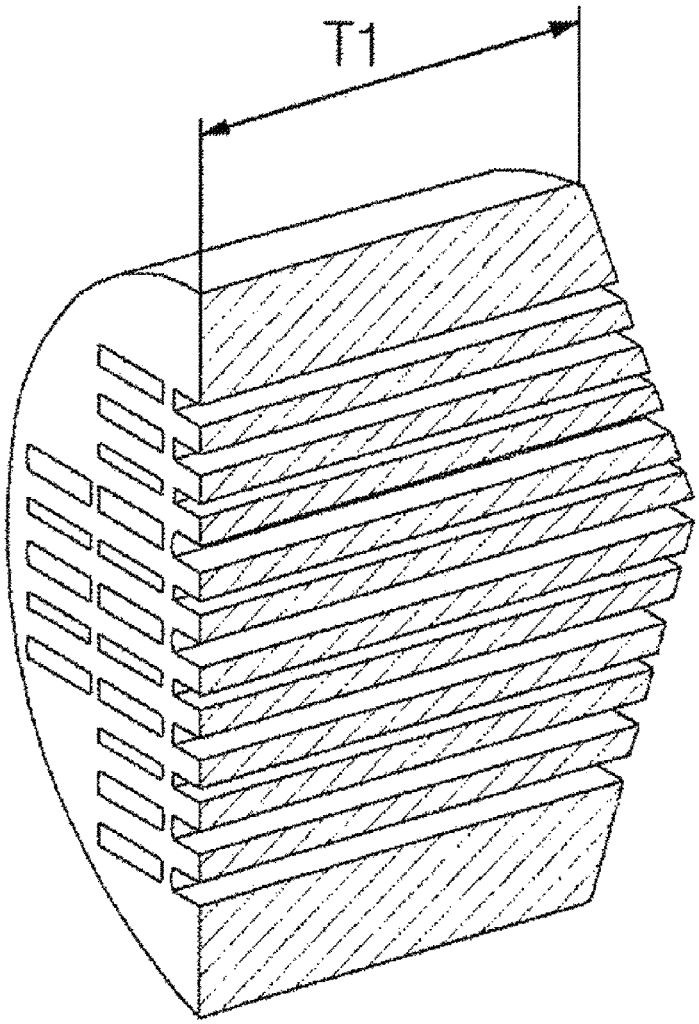
FIG. 7A is a cross-sectional perspective view of an air tap having a wide thickness according to an embodiment of the present invention.
Figure 7B:
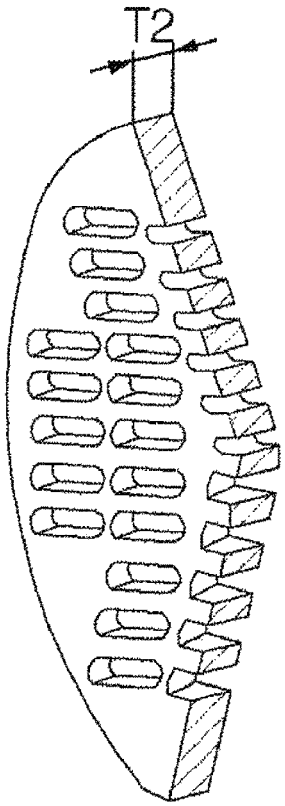
FIG. 7B is a cross-sectional perspective view of an air tap having a narrow thickness according to another embodiment of the present invention.

The thickness of the air tap 180 may be formed to be thick with a thickness T1 of 30 mm or more as shown in FIG. 7A, or may be formed with a thickness T2 ranging from 2 to 5 mm as shown in FIG. 7B.

As the thickness of the air tap 180 becomes thinner, the possibility of clogging due to foreign substances is lowered, and there is an advantage that mass production is easy. Since the effect of crushing the air is not significantly different depending on the thickness of the air tap 180, it is preferable that the thickness of the air tab 180 is manufactured with a thickness T2 ranging from 2 to 5 mm as shown in FIG. 7B.

The discharge pipe 220 has a shape in which a side end surface of the flow path is reduced at a portion where the washing water is introduced. In the discharge end of the air crushing pipe 110, the flow path is expanded for the air crushing, and the discharge pipe 220 has a shape in which a side end surface of the flow path is reduced at a portion where the washing water is introduced, in order to reduce the size of the flow path volume of the discharge pipe 220 connected to the tub 18 or the sump 20.

Figure 8:
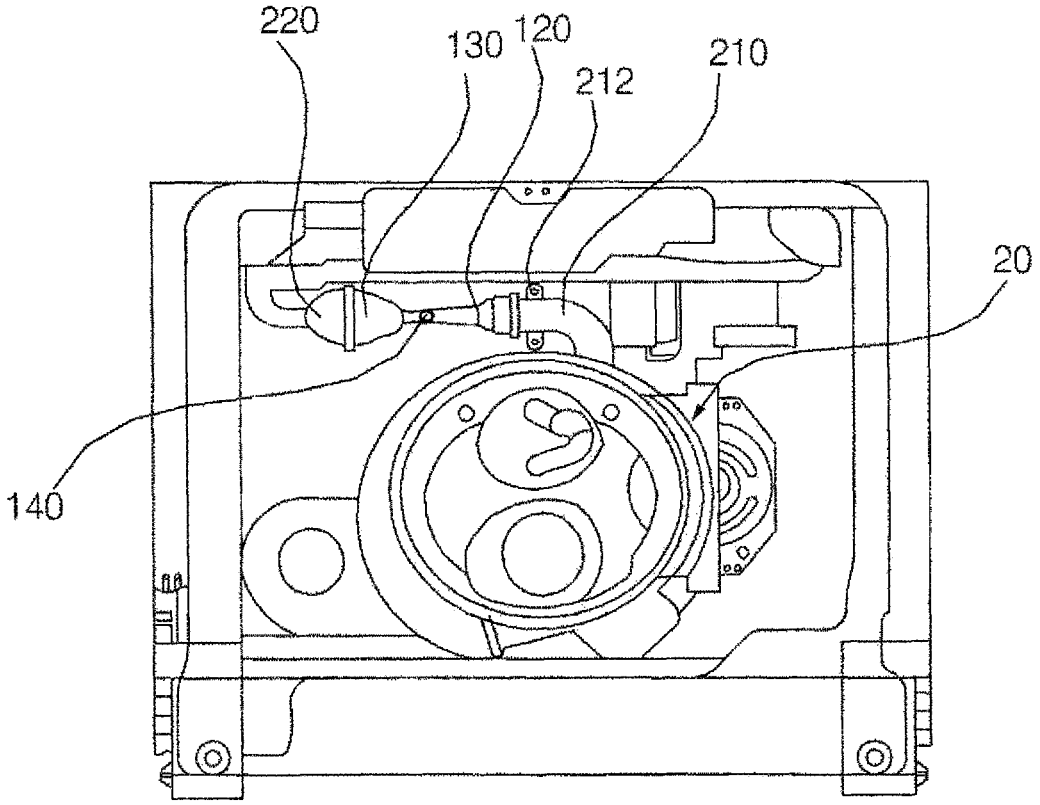
FIG. 8 is a diagram for explaining the disposition of an air jet generator according to the present embodiment.
Figure 9:
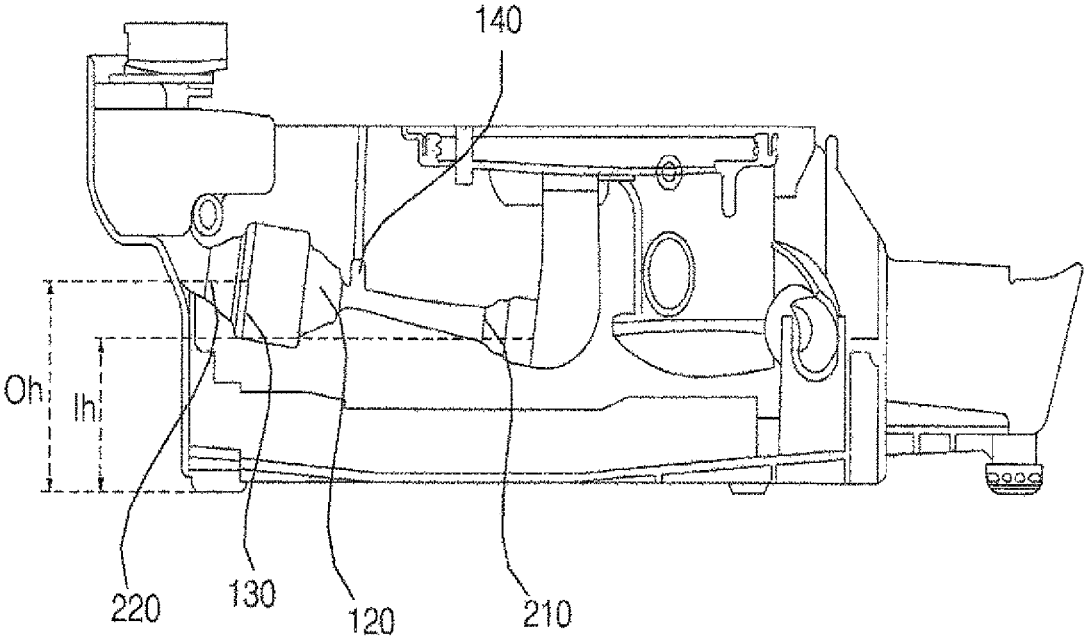
FIG. 9 is a diagram for explaining a side disposition of an air jet generator according to the present embodiment.

FIG. 8 is a diagram for explaining the disposition of an air jet generator according to the present embodiment, and FIG. 9 is a diagram for explaining a side disposition of an air jet generator according to the present embodiment.

Referring to FIG. 8, the air jet generator 100 is disposed in the lateral of the lower portion of the dishwasher 10. The air jet generator 100 sucks air, is disposed in the lower portion of the dishwasher 10 in consideration of vibration and noise generated in the process of forming the air bubbles, and is disposed in the lateral close to the pump 40 to minimize the flow path volume.

The inflow pipe 210 includes an inflow pipe fixing portion 212 for fixing the inflow pipe 210. Since vibration occurs as air is sucked and crushed, the air jet generator 100 may include the inflow pipe fixing portion 212 for minimizing such vibration. The inflow pipe fixing portion 212 may be fixed to the lower portion of the cabinet 14. The discharge pipe 220 may include a discharge pipe fixing portion (not shown) for fixing the discharge pipe 220, and the discharge pipe fixing portion may be fixed to the side surface of the cabinet 14.

Referring to FIG. 9, the height (Oh) of the center of the discharge end of the pressing portion 130 from the lower end of the dishwasher 10 is disposed higher than the height (Ih) of the center of the inflow end of the decompression portion 130 from the lower end of the dishwasher 10. Since the center of the discharge end of the air crushing pipe 110 is disposed higher than the center of the inflow end, even if the pump stops operating, residual water remaining in the air jet generator 100 is discharged to the inflow pipe 210, so that the water is not accumulated inside the generator 100.

Figure 10:
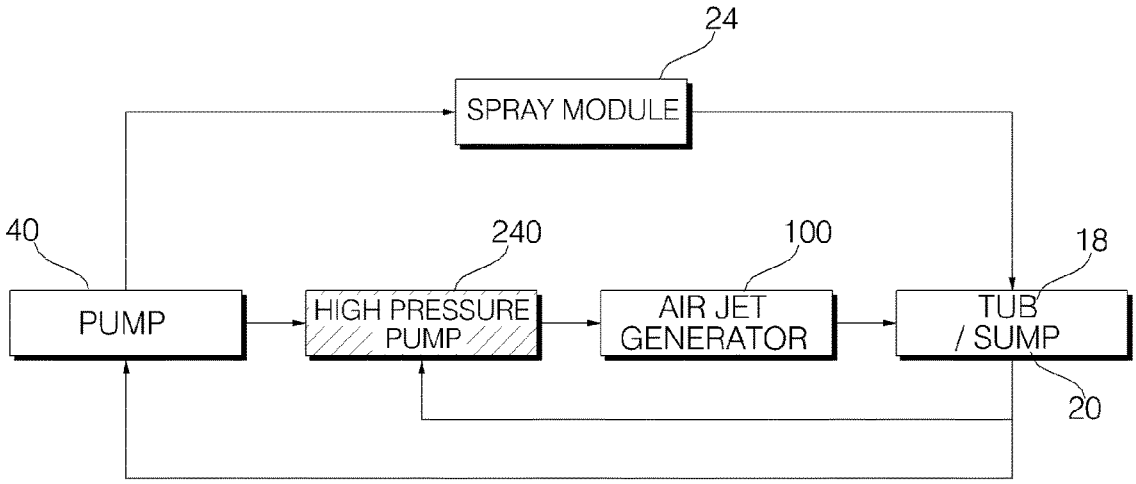
FIG. 10 is a block diagram of a dishwasher including an air jet generator and a high pressure pump according to another embodiment of the present invention.

FIG. 10 is a block diagram of a dishwasher including an air jet generator and a high pressure pump according to another embodiment of the present invention.

Referring to FIG. 10, in the dishwasher 10 according to another embodiment of the present invention, the washing water stored in the sump 20 is supplied to the spray module 24 through the pump 40, and flows into the sump 20 through the tub 18.

The air jet generator 100 may be connected to the sump 20 through a separate high pressure pump 240 without being connected to the branch pipe 230 branched from the pump 40. Accordingly, the washing water stored in the sump 20 flows to the spray module 24 through the pump 40 or flows to the air jet generator 100 through the high pressure pump 240 to form an air bubble.

According to another embodiment of the present invention, when the dishwasher 10 includes a separate high pressure pump 240, the pressure of the washing water flowing into the air crushing pipe 110 is strongly formed, which is advantageous in forming air bubbles.

In addition, the dishwasher 10 according to the present embodiment may further include a separate air pump (not shown) connected to the air jet generator 100. The air pump is connected to the air suction portion and can inject air into the air jet generator. As described above, when the dishwasher 10 includes a separate air pump, it is possible to control the amount of air flowing into the air crushing pipe 110, which is advantageous in forming air bubbles.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

| [Description of numeral] | |
|---|---|
| 10: dishwasher | 20: sump |
| 40: pump | 100: air jet generator |
| 110: air crushing pipe | 120: decompression portion |
| 130: pressing portion | 140: air suction portion |
| 170: impeller | 180: air tap |
| 210: inflow pipe | 220: discharge pipe |
| 240: high pressure pump | |

The invention claimed is:

1. A dishwasher comprising:

a spray module which sprays washing water toward dishes;

a sump which supplies washing water to the spray module;

a pump which pumps the washing water stored in the sump to the spray module; and an air jet generator which receives a part of the washing water pumped from the pump to form an air bubble in the washing water and discharges the air bubble to the sump, wherein the air jet generator comprises:

a decompression portion providing a cross-sectional area that reduces in a water flowing direction and that decreases a pressure of the received washing water;

an air suction portion that is disposed at an end of the decompression portion and that provides an opening to allow air to flow into the decompression portion;

a pressing portion providing a cross-sectional area that increases in the water flowing direction and that increases pressure so as to crush the air introduced from the air suction portion;

an impeller configured to apply centrifugal force to the washing water that flows to the decompression portion;

an air tap which has a plurality of holes formed therein so as to crush the air contained in washing water that passed through the pressing portion; and an air tap mounting portion providing a cross-sectional area that extends in constant size from an end of the pressing portion and mounts the air tap, wherein the air tap is disposed and spaced apart from the end of the pressing portion at a predetermined interval, and wherein a reduction ratio of the cross-sectional area of the decompression portion is less than an increment ratio of the cross-sectional area of the pressing portion.

2. The dishwasher of claim 1, wherein the impeller comprises an impeller circumferential portion having an annular outer shape and a vane disposed inside the impeller circumferential portion to apply centrifugal force to washing water.

3. The dishwasher of claim 1, wherein the air suction portion is disposed in a portion where decompression of the decompression portion is terminated.

4. The dishwasher of claim 3, wherein the air suction portion forms an air suction port opened upwardly.

5. The dishwasher of claim 1, wherein a width of a discharge end of the pressing portion is larger than a width of an inflow end of the decompression portion.

6. The dishwasher of claim 1, wherein a shape of the plurality of holes formed in the air tap is elongated in a left and right direction.

7. The dishwasher of claim 1, wherein the air tap has a thickness ranging from 2 to 5 mm.

8. The dishwasher of claim 1, wherein a distance between the air tap and the pressing portion is equal to or larger than a diameter of a cross-section of the air tap.

9. The dishwasher of claim 1, further comprising a branch pipe for sending a part of the washing water pumped from the pump to the air jet generator.

10. The dishwasher of claim 1, further comprising a tub that is disposed above the sump and that defines a washing space, wherein the air jet generator is disposed below the tub.

11. The dishwasher of claim 1, wherein, in the air jet generator, a center of a discharge end of the pressing portion is disposed higher than a center of an inflow end of the decompression portion.

12. A dishwasher comprising:

a spray module which sprays washing water toward dishes;

a sump which supplies washing water to the spray module;

a pump which pumps the washing water stored in the sump to the spray module; and an air jet generator which receives a part of the washing water stored in the sump and forms an air bubble in the washing water; and a high pressure pump that pumps the washing water of the sump to the air jet generator, wherein the air jet generator comprises:

an impeller which applies centrifugal force to the washing water that flows;

a decompression portion providing a cross-sectional area that reduces in a water flowing direction and that decreases a pressure of the washing water that passed through the impeller;

an air suction portion that is disposed at an end of the decompression portion and that provides an opening to allow air to flow into the decompression portion;

a pressing portion providing a cross-sectional area that increases in the water flowing direction and that increases pressure so as to crush the air introduced from the air suction portion;

an air tap which has a plurality of holes formed therein so as to crush the air contained in washing water that passed through the pressing portion; and an air tap mounting portion providing a cross-sectional area that extends in constant size from an end of the pressing portion and mounts the air tap, wherein the air tap is disposed and spaced apart from the end of the pressing portion at a predetermined interval, and wherein a reduction ratio of the cross-sectional area of the decompression portion is less than an increment ratio of the cross-sectional area of the pressing portion.

13. The dishwasher of claim 12, wherein the impeller comprises an impeller circumferential portion having an annular outer shape and a vane disposed inside the impeller circumferential portion to apply centrifugal force to washing water.

14. The dishwasher of claim 12, wherein the air suction portion is disposed in a portion where decompression of the decompression portion is terminated.

15. The dishwasher of claim 14, wherein the air suction portion forms an air suction port opened upwardly.

16. The dishwasher of claim 12, wherein a width of a discharge end of the pressing portion is larger than a width of an inflow end of the decompression portion.

17. The dishwasher of claim 12, wherein a shape of the plurality of holes formed in the air tap is elongated in a left and right direction.

18. The dishwasher of claim 12, wherein the air tap has a thickness ranging from 2 to 5 mm.

19. The dishwasher of claim 12, wherein a distance between the air tap and the pressing portion is equal to or larger than a diameter of a cross-section of the air tap.

20. The dishwasher of claim 12, further comprising a branch pipe for sending a part of the washing water pumped from the pump to the air jet generator.

* * * * *